US010081904B2

(12) United States Patent
Valiyambath Krishnan et al.

(10) Patent No.: US 10,081,904 B2
(45) Date of Patent: Sep. 25, 2018

(54) HAND-HELD STEAMING DEVICE

(71) Applicant: KONINKLIJKE PHILIPS N.V., Eindhoven (NL)

(72) Inventors: Mohankumar Valiyambath Krishnan, Eindhoven (NL); Linfang Xu, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 26 days.

(21) Appl. No.: 15/504,032

(22) PCT Filed: Aug. 25, 2015

(86) PCT No.: PCT/EP2015/069408
§ 371 (c)(1),
(2) Date: Feb. 15, 2017

(87) PCT Pub. No.: WO2016/030355
PCT Pub. Date: Mar. 3, 2016

(65) Prior Publication Data

US 2017/0275811 A1 Sep. 28, 2017

(30) Foreign Application Priority Data

Aug. 26, 2014 (EP) ..... 14182181

(51) Int. Cl.
*D06F 75/14* (2006.01)
*D06F 75/26* (2006.01)

(52) U.S. Cl.
CPC ..... *D06F 75/14* (2013.01); *D06F 75/26* (2013.01)

(58) Field of Classification Search
CPC ..... D06F 75/00; D06F 75/10; D06F 75/12; D06F 75/14; D06F 75/16; D06F 75/18; D06F 75/24; D06F 75/26; D06F 87/00
See application file for complete search history.

(56) References Cited

U.S. PATENT DOCUMENTS 3,747,241 A * 7/1973 Davidson ..... D06F 75/18 38/77.83
5,345,704 A * 9/1994 Guillot ..... D06F 75/18 38/77.83

(Continued)

FOREIGN PATENT DOCUMENTS

EP 2397063 A1 12/2011
JP 4957195 U 5/1974

(Continued)

*Primary Examiner* — Ismael Izaguirre

(57) ABSTRACT

The present application relates to a hand-held steaming device (10). The hand-held steaming device comprises a steam generating surface (4A), a heater (5) to heat the steam generating surface, a water supply unit (6) to supply water to the steam generating surface and a sensor (12) configured to detect the inclination of the steam generating surface with respect to the horizontal. The hand-held steaming device further comprises a controller (11) configured to perform a user selectable descaling process wherein the heater is operated to heat the steam generating surface to a first temperature and the water supply unit is operated to supply water to the steam generating surface at a first flow rate to remove scale from the steam generating surface. The controller is coupled to the sensor and is configured to prevent the water supply unit from supplying water to the steam generating surface at the first flow rate and/or the heater from heating the steam generating surface to the first temperature when the descaling process is selected if the steam generating surface is inclined by more than a first predetermined angle from the horizontal (X-X).

15 Claims, 4 Drawing Sheets

(56) References Cited

U.S. PATENT DOCUMENTS

| | | | | |
|---|---|---|---|---|
| 5,751,074 | A * | 5/1998 | Prior | H01H 29/002 200/190 |
| 5,926,983 | A * | 7/1999 | Tee | D06F 75/14 38/77.82 |
| 6,104,009 | A * | 8/2000 | Man | H05B 1/0225 219/253 |
| 7,114,273 | B2 | 10/2006 | Giovalle | |
| 7,181,874 | B2 | 2/2007 | Uebele | |
| 7,908,776 | B2 | 3/2011 | Ng | |
| 8,141,279 | B2 | 3/2012 | Jiang | |
| 8,402,597 | B2 * | 3/2013 | Rosenzweig | A47L 13/225 15/320 |
| 8,776,409 | B2 * | 7/2014 | Noto | D06F 71/34 38/77.3 |
| 8,800,180 | B2 * | 8/2014 | Ong | D06F 75/10 219/250 |
| 2010/0242314 | A1 | 9/2010 | Aiura | |
| 2013/0125427 | A1 * | 5/2013 | De Vries | D06F 75/22 38/14 |

FOREIGN PATENT DOCUMENTS

| | | | |
|---|---|---|---|
| JP | 06327900 | A | 11/1994 |
| JP | 07236798 | A | 9/1995 |
| JP | 2000070599 | A | 3/2000 |
| WO | 2004032018 | A1 | 4/2004 |
| WO | 2005014917 | A1 | 2/2005 |

* cited by examiner

HAND-HELD STEAMING DEVICE

This application is the U.S. National Phase application under 35 U.S.C. § 371 of International Application No. PCT/EP2015/069408, filed on Aug. 25, 2015, which claims the benefit of International Application No. 14182181.9 filed on Aug. 26, 2014. These applications are hereby incorporated by reference herein.

FIELD OF THE INVENTION

The present invention relates to a hand-held steaming device. The present invention also relates to a descaling process for removing scale from the steam generating surface of a hand-held steaming device, and to a controller that is configured to perform the descaling process.

BACKGROUND OF THE INVENTION

A typical steam iron comprises a housing incorporating a handle, a heel on which the iron rests when not in use, and a heated soleplate which is placed in contact with the fabric to be ironed. The heated soleplate is moved over the fabric to remove creases from the fabric.

The steam iron further comprises a water reservoir. Water from the water reservoir is supplied to a heated steam generating surface of the soleplate and is converted into steam. The steam is channeled through the soleplate and exits through steam vents onto the fabric to assist with crease removal.

In steam irons, as described above, the soleplate plays an important role in the effectiveness of the ironing function. However, it is known that prolonged use of steam irons causes minerals, known as scale, to be deposited on the steam generating surfaces of the soleplate. The minerals are left behind by the evaporated water. The accumulation of these deposits reduces the efficiency with which the soleplate converts water into steam.

U.S. Pat. No. 7,181,874 discloses a steam iron capable of performing a self-cleaning process to remove scale. However, it has been found that under certain conditions the self-cleaning purpose can result in scalding of the user.

SUMMARY OF THE INVENTION

It is an object of the invention to provide a hand-held steaming device and a descaling process for removing scale from the steam generating surface of a hand-held steaming device which substantially alleviates or overcomes the problems mentioned above.

According to the present invention, there is provided a hand-held steaming device comprising a steam generating surface; a heater to heat the steam generating surface; a water supply unit to supply water to the steam generating surface; a controller configured to perform a user selectable descaling process wherein the heater is operated to heat the steam generating surface to a first temperature and the water supply unit is operated to supply water to the steam generating surface at a first flow rate to remove scale from the steam generating surface; and, a sensor configured to detect the inclination of the steam generating surface with respect to the horizontal, wherein the controller is coupled to the sensor and is configured to prevent at least one of the following when the descaling process is selected if the steam generating surface is inclined by more than a first predetermined angle from the horizontal: the water supply unit from supplying water to the steam generating surface at the first flow rate: and, the heater from heating the steam generating surface to the first temperature.

If the controller is configured such that the water supply unit is prevented from supplying water to the steam generating surface at the first flow rate when the descaling process is selected and the steam generating surface is inclined by more than a first predetermined angle from the horizontal, then the liquid water is prevented from running to a lower end of the steam generating surface and accumulating to form a water deposit. Such a water deposit could otherwise block steam from exiting the hand-held steaming device and so the pressure of the steam would increase in the steam generating device until it is sufficient to be forced through the water deposit, at which point a sudden burst of steam and hot water is ejected from the hand-held steaming device. Therefore, the problem of the user being scalded by sudden bursts of steam and hot water during the descaling process is alleviated. If the controller is configured such that the heater is prevented from heating the steam generating surface to at or above the first temperature when the descaling process is selected and the steam generating surface is inclined by more than a first predetermined angle from the horizontal, then even if a water deposit were to block steam from exiting the hand-held steaming device, the heater would not heat the trapped steam to increase the pressure thereof such that a sudden burst of steam and hot water is ejected from the hand-held steaming device. Therefore, the problem of the user being scalded by sudden bursts of steam and hot water during the descaling process is alleviated.

In one embodiment, the water supply unit is operable to supply water to the steam generating surface at a second flow rate to generate steam for steaming a fabric and the first flow rate is greater than the second flow rate. Therefore, liquid water can be supplied to the steam generating surface at the second flow rate to generate steam to remove creases from a fabric and the descaling process can be selected to such that liquid water is supplied to the steam generating surface at the first flow rate to remove scale from the steam generating surface.

In one embodiment, the controller is configured to prevent at least one of the following when the descaling process is selected if the steam generating surface is inclined by less than a second predetermined angle from the horizontal, wherein the second predetermined angle is smaller than the first predetermined angle: the water supply unit from supplying water to the steam generating surface at the first flow rate; and, the heater from heating the steam generating surface to the first temperature.

Water may be supplied to the steam generating surface from a water tank provided within the housing of the hand-held steaming device or in a separate base or stand. In one such embodiment, a pump is used to supply water from the base or stand via a hose to the steam generating surface. The pump and/or water tank may be located in the housing of the hand-held steaming device or in the separate base or stand.

The separate base or stand may be provided with a receiving surface for a fabric treating face or other part of the hand-held steaming device. The receiving surface may be inclined with respect to the horizontal. In one such embodiment, the receiving surface is inclined at an angle between the first and second predetermined angles. The separate base or stand may comprise a sensor to detect the presence of the fabric treating face or other part of the hand-held steaming device against the receiving surface. Said sensor may comprise a mechanically activated electrical switch, a magnetic sensor or a capacitive sensor.

The first predetermined angle may be between 2 and 90 degrees. Preferably, the first predetermined angle is 6 degrees.

In one embodiment, the controller is configured to prevent the water supply unit from supplying water to the steam generating surface when the descaling process is selected unless the temperature of the steam generating surface is at least the first temperature. Therefore, water is only supplied to the steam generating surface during the descaling process if the temperature of the steam generating surface is sufficiently hot to cause thermal shock of scale on the steam generating surface. The hand-held steaming device may further comprise a temperature sensor that is coupled to the controller and is configured to detect the temperature of the steam generating surface.

The hand-held steaming device may comprise a heel and the controller may be configured to prevent the water supply unit from supplying water to the steam generating surface at the at the first flow rate if the hand-held steaming device is rested on the heel. This prevents the water supply unit from supplying water to the steam generating surface at the first flow rate and/or the heater from heating the steam generating surface to the first temperature when the descaling process is selected and the hand-held steaming device is left unattended, which could otherwise result in a sudden burst of steam/hot water being ejected from the hand-held steaming device at the same moment a person moves in front of the hand-held steaming device.

In one embodiment, the water supply unit comprises a pump. The pump may comprise a motor and the controller may be configured to control the motor to control the flow rate of water supplied to the steam generating surface by the water supply unit. The controller may adjust the speed of the motor to control the flow rate of water supplied to the steam generating surface. In another embodiment, the pump is driven by a solenoid and the controller is configured to control the solenoid to control the flow rate of water supplied to the steam generating surface. In one such embodiment, the solenoid is an AC solenoid and the effective driving electrical pulse rate or frequency of the AC solenoid is adjusted by the controller to control the flow rate of water supplied to the steam generating surface by the water supply unit.

The hand-held steaming device may comprise an alarm and the controller may be configured to activate the alarm if the descaling process is selected and the steam generating surface is inclined by more than the predetermined angle from the horizontal. This notifies the user that the steam generating plate is inappropriately orientated for the water supply unit and/or heater to be operated to remove scale from the steam generating surface. In one such embodiment, the alarm comprises an audible alarm and may comprise a buzzer. Alternatively, or additionally, the alarm may comprise a visual alarm and may comprise a flashing LED.

In one embodiment, the hand-held steaming device comprises a steam chamber, wherein the steam generating surface forms a wall of the steam chamber, and the controller is configured to prevent a water deposit accumulating in the steam chamber that blocks a flow of steam out of the steam chamber. This prevents the pressure of steam in the steam chamber building up until the steam is suddenly ejected in a burst from the hand-held steaming device.

The hand-held steaming device may comprise a steam generating plate having a major surface that comprises the steam generating surface and/or may comprise a fabric treating face that is parallel to the steam generating surface.

In one embodiment, the hand-held steaming device is in the form of a steam iron.

According to another aspect of the present invention, there is provided a descaling process for removing scale from the steam generating surface of a hand-held steaming device, wherein the hand-held steaming device comprises a heater to heat the steam generating surface and a water supply unit to supply water to the steam generating surface, wherein the descaling process comprises the steps of: controlling the heater to heat the steam generating surface to a first temperature; controlling the water supply unit to supply water to the steam generating surface at a first flow rate; detecting the inclination of the steam generating surface with respect to the horizontal; and, preventing at least one of the following if the steam generating surface is inclined by more than a predetermined angle from the horizontal: the water supply unit from supplying water to the steam generating surface at the first flow rate; and, the heater from heating the steam generating surface to the first temperature.

According to another aspect of the present invention, there is provided a controller comprising a memory and a processor configured to perform the descaling process according to the invention.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
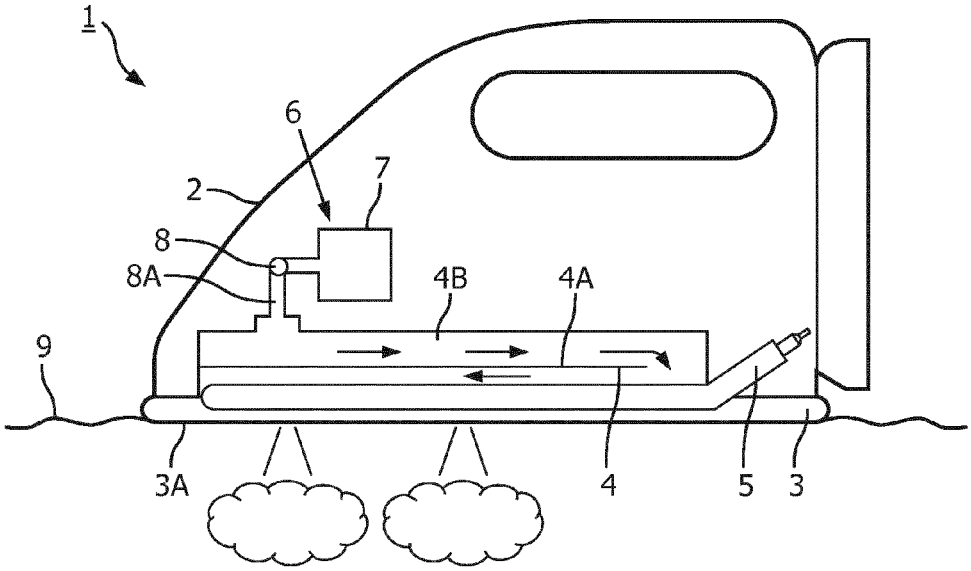
FIG. 1 is a schematic cross-sectional side view of a known steam iron, wherein a steam generating surface of the steam iron is in a horizontal position.
Figure 2:
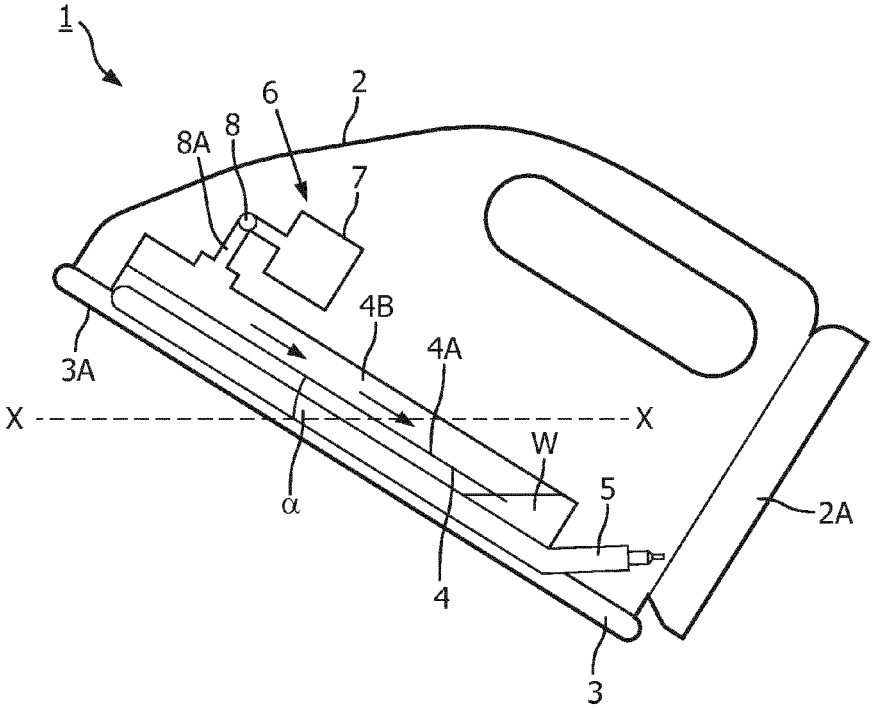
FIG. 2 is a schematic cross-sectional side view of the steam iron of FIG. 1, wherein the steam generating surface is in an inclined position.

Referring to FIGS. 1 and 2, a known steam iron 1 is shown. The steam iron 1 comprises a housing 2, a soleplate 3 and a steam generating plate 4. A major surface of the soleplate 3 comprises a fabric treating face 3A which, during use, is located against a fabric 9 to be treated by steam. The steam generating plate 4 comprises a steam generating surface 4A that is parallel to the fabric treating face 3A of the soleplate 3 and faces in the opposite direction thereto. The steam generating surface 4A forms a wall of a steam chamber 4B that is disposed inside the housing 2 of the steam iron 1.

FIG. 1 shows the steam iron 1 in a typical in-use or ironing position, with the fabric treating face 3A of the soleplate 3 facing downwardly so that the weight of the steam iron 1 will rest on the fabric 9 being ironed. The housing 2 comprises a base or heel 2A that is disposed at an end of the housing 2. When not in use, the steam iron 1 may be placed in a stable, non-ironing, upright position resting on its heel 2A so that the soleplate 3 is out of contact with any surfaces.

A heater 5 is disposed between the fabric treating face 3A and the steam generating surface 4A. The heater 5 comprises a resistive heating element that is connected to an electrical power supply (not shown) and is configured to heat the soleplate 3 and steam generating plate 4.

A water supply unit 6 is disposed inside the housing 2 of the steam iron 1. The water supply unit 6 comprises a water tank 7, a pump 8 and a nozzle 8A. The pump 8 is configured to supply liquid water from the water tank 7 to the nozzle 8A. The nozzle 8A is arranged to spray, drip or jet the liquid water supplied thereto onto the steam generating surface 4A such that the liquid water spreads over the steam generating surface 4A. Therefore, when the steam generating surface 4A is heated by the heater 5, the liquid water on the steam generating surface 4A evaporates into steam inside the steam chamber 4B. The steam flows along the steam chamber 4B and then through apertures (not shown) provided in the soleplate 3 to be expelled from the fabric treating face 3A. Therefore, fabric 9 located against the fabric treating face 3A will be treated by the steam.

Since the heater 5 used to generate the steam in the housing 2 also heats the soleplate 3, a build up of wet spots on the fabric treating face 3A due to condensation is prevented. Such wet spots could otherwise be transferred to the fabric 9 being treated. The heated soleplate 3 also provides the advantage of drying the fabric 9 being treated.

Prolonged use of the steam iron 1 causes minerals, known as scale, to be deposited on the steam generating surface 4A of the steam generating plate 4. The minerals are left behind by the evaporated water.

The steam iron 1 is capable of performing a decalcification or descaling process to remove the scale from the steam generating surface 4A and other internal components of the steam iron 1. The descaling process is activated upon actuation of a push button (not shown) by the user.

The descaling process is as follows. Firstly, the steam generating surface 4A is heated to a predetermined temperature. The predetermined temperature is a relatively high temperature, for example, 150 degrees Celsius and above, and preferably above 180 degrees Celsius. Secondly, the pump 8 of the water supply unit 6 is activated to supply liquid water at a first flow rate from the water tank 7 to the steam generating surface 4A.

The first flow rate is relatively high in comparison to the flow rate of liquid water supplied to the steam generating surface 4A to generate steam when the steam iron 1 is operated to remove creases from fabric. The liquid water is supplied to the steam generating surface 4A for a predetermined period of time, or until the user deactivates the descaling process.

The liquid water being supplied to the steam generating surface 4A during the descaling process results is cold relative to the temperature of the heated steam generating surface 4A. Therefore, any scale on the steam generating surface 4A will be subjected to thermal shock such that the scale is dislodged and broken into flakes and powder which can be flushed out of the steam chamber 4B by the liquid water and through the apertures (not shown) in the fabric treating face 3A.

More specifically, the high temperature of the steam generating surface 4A combined with the relatively low temperature of the liquid water being fed onto the steam generating surface 4A means that any scale on the steam generating surface 4A will be subjected to a high thermal shock which will break apart and dislodge the scale. This is because the scale formed on the steam generating surface 4A will have a different thermal expansion coefficient to the material of the steam generating surface 4A itself. Therefore, as liquid water is supplied to the steam generating surface 4A during the descaling process, the scale will cool at a different rate to the material of the steam generating surface 4A and then be heated up at a different rate as the heat energy is transferred to the water. This will cause a differential rate of contraction and expansion of the scale compared to the material of the steam generating surface 4A, which will induce stresses and strains in the scale, causing it to break apart into particles and detach from the steam generating surface 4A, which are then flushed out of the apertures (not shown) in the fabric treating face 3A. Even if the material of the steam generating surface 4A does not undergo any significant contraction when water is fed onto the steam generating surface 4A, any accumulated scale will be cooled by the water and the thermal shock of this differential cooling will break apart the scale and allow it to be flushed out of the apertures in the fabric treating face 3A.

Moreover, once cracks and gaps are formed in the scale layer on the steam generating surface 4A, liquid water being fed onto the steam generating surface 4A by the water supply unit 6 will flow through those cracks and into the gaps and onto the steam generating surface 4A. As this water contacts the steam generating surface 4A it will evaporate and undergo an increase in volume as it turns into steam. This will push the scale away from the steam generating surface 4A and provides a further force acting to break apart the scale.

It is necessary to supply a relatively high flow rate of liquid water to the steam generating surface 4A during the descaling process to ensure sufficient cooling of the scale to cause thermal shock. However, it has been found that the high flow rate of liquid water can result in liquid water accumulating in the steam chamber 4B if the steam iron 1 is not orientated correctly. More specifically, during the descaling process the steam iron 1 should be orientated such that the steam generating surface 4A is substantially horizontal (as shown in FIG. 1). Therefore, when the liquid water is supplied to the steam generating surface 4A during the descaling process, the water is able to spread out over the steam generating surface 4A such that steam and/or hot water is continuously discharged from the apertures in the soleplate 3 to discharge scale from the steam iron 1.

It has been found that if the steam iron 1 is orientated such that the steam generating surface 4A is inclined at an angle $\alpha$ with respect to the horizontal (shown by chain-dashed line X-X in FIG. 2), then the liquid water will flow along the steam generating surface 4A and accumulate at an end of the steam chamber 4B to form a water deposit W. For example, if the steam generating surface 4A is inclined at an angle $\alpha$ with respect to the horizontal X-X such that the steam generating surface 4A slopes upwardly in a direction away from the heel 2A of the steam iron 1, then when the high flow rate of liquid water is supplied to the steam generating surface 4A by the water supply unit 6 during the descaling process the liquid water will quickly flow across the steam generating surface 4A under gravity. There will be insufficient time for the steam generating surface 4A to evaporate all of the liquid water into steam and so the liquid water will accumulate at the lower end of the steam chamber 4B, proximate to the heel 2A (as shown in FIG. 2).

It has been found that the accumulation of a water deposit W at an end of the steam chamber 4B during the descaling process can result in scalding of the user. This is because the water deposit W blocks the steam and/or hot water from exiting the steam chamber 4B and being vented from the apertures in the soleplate 3 and so prevents the continuous discharge of steam and/or hot water from the apertures in the soleplate 3. Instead, steam accumulates in the steam chamber 4B until the pressure of the steam in the steam chamber 4B is sufficient to force the steam through the water deposit W, at which point a sudden large burst of steam and hot water is vented through the apertures in the soleplate 3. This sudden burst of steam and hot water can scald the user.

In addition, if the steam iron 1 is orientated such that the steam generating surface 4A is inclined and a water deposit W forms during the descaling process and then the user orientates the steam iron 1 such that the steam generating surface 4A is orientated horizontally, the liquid water that has accumulated as a water deposit W will spread over the steam generating surface 4A and be quickly evaporated into steam. This can result in a large burst of steam being expelled from apertures in the fabric treating face 3A, which may also scald the user.

Referring to FIGS. 3 to 7, a hand-held steaming device 10 according to an embodiment of the present invention is shown. The hand-held steaming device 10 is in the form of a steam iron 10.

The steam iron 10 comprises a housing 2, soleplate 3, steam generating plate 4, heater 5 and water supply unit 6 which are similar to those described above in relation to the known steam iron 1 of FIGS. 1 and 2, with like features retaining the same reference numerals.

The water supply unit 6 is operable to supply liquid water to the steam generating plate 4 at a first flow rate to remove scale from the steam generating surface 4A and at a second flow rate to generate steam when the steam iron 10 is operated to remove creases from fabric. The first flow rate is relatively high in comparison to the second flow rate.

A difference between the steam iron 10 of the present invention and the known steam iron 1 of FIGS. 1 and 2 is that the steam iron 10 of the present invention comprises a controller 11, an inclination sensor 12 and a temperature sensor 13.

The inclination sensor 12 may be in the form of an inclinometer 12 and is configured to measure the angle α of inclination of the steam generating surface 4A with respect to the horizontal (shown by the chain-dashed line X-X in FIGS. 3 to 5), referred to hereinafter as the 'inclination angle α'. In an alternative embodiment (not shown), the inclination sensor 12 comprises an orientation sensor in the form of, for example, a ball sensor (now shown) that has a cylinder containing a moveable conductive ball. The conductive ball moves to make and break electrical contacts at opposite ends of the cylinder depending on the inclination of the steam generating surface 4A to detect the inclination thereof. The cylinder may be inclined by an angle with respect to the horizontal X-X such that the steam generating surface 4A must be inclined by more than said angle before the ball moves between the ends of the cylinder to make an electrical contact. Therefore, the ball is prevented from moving between ends of they cylinder if the steam iron 10 is only moved slightly and the steam generating surface 4A is only inclined relative to the horizontal X-X by a small amount.

Figure 3:
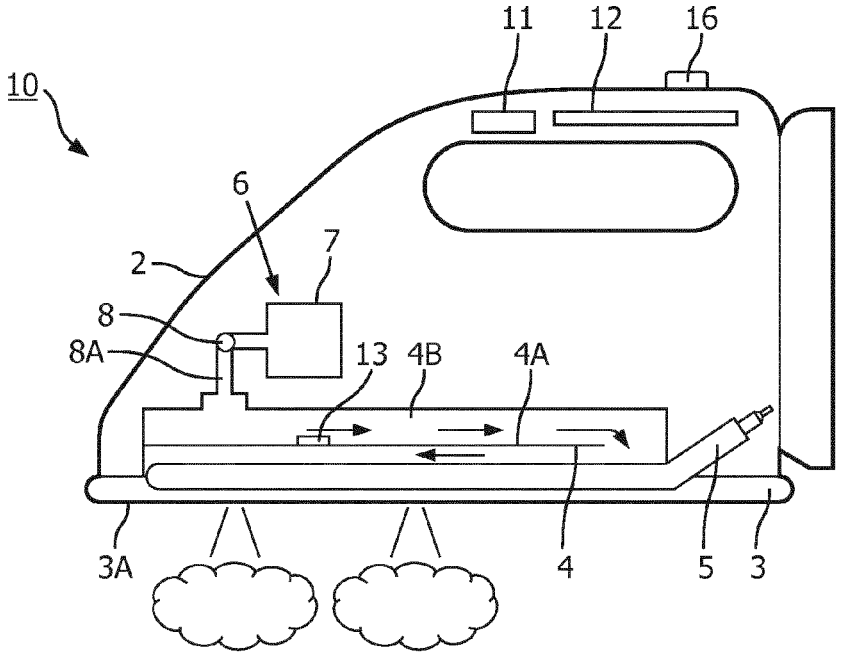
FIG. 3 is a schematic cross-sectional side view of a steam iron according to an embodiment of the invention, wherein a steam generating surface of the steam iron is in a horizontal position.

When the steam generating surface 4A is horizontal (as shown in FIG. 3), the inclination angle α of the steam generating surface 4A is zero degrees.

The inclination sensor 12 is disposed in or on the housing 2 of the steam iron 10 and is fixed relative to the steam generating surface 4A such that movement of the steam generating surface 4A results in corresponding movement of the inclination sensor 12.

The value of the inclination angle α of the steam generating surface 4A that is measured by the inclination sensor 12 is input into the controller 11.

Figure 4:
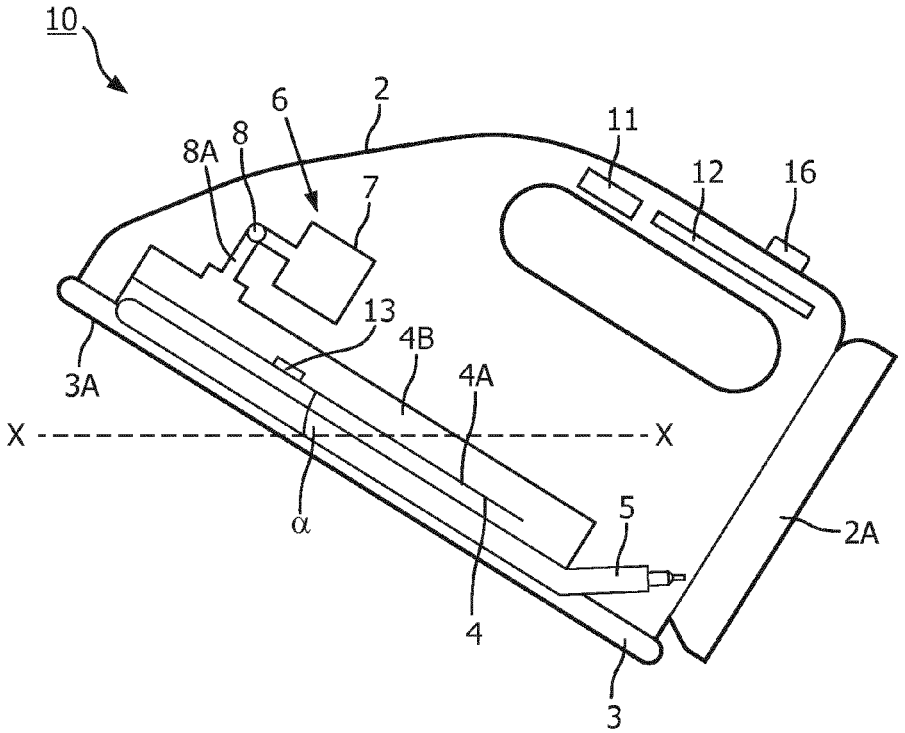
FIG. 4 is a schematic cross-sectional side view of the steam iron of FIG. 3, wherein the steam generating surface is in an inclined position.
Figure 5:
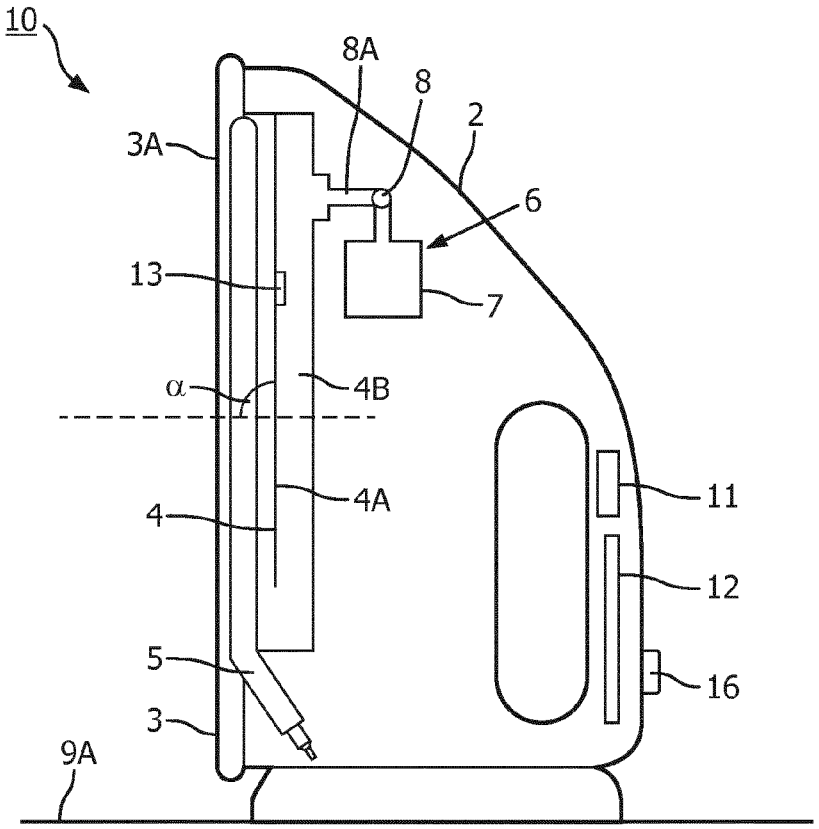
FIG. 5 is a schematic cross-sectional side view of the steam iron of FIG. 3, wherein the steam generating surface is in an upright position.
Figure 6:
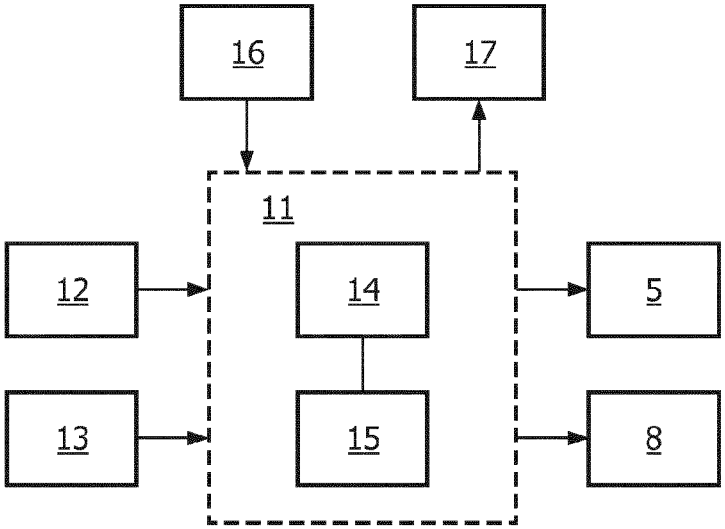
FIG. 6 is a schematic block diagram of the steam iron of FIGS. 3 to 5; and, FIG. 7 is a flow chart of an example operation process of the steam iron of FIGS. 3 to 5.

The location of the controller 11 within the housing 2 of the steam iron 10 is shown in FIGS. 3 to 5. However, it should be recognised that the controller 11 may be located in another position within the housing 2 or alternatively the controller 11 may be located, for example, on the exterior of the housing 2. The controller 11 comprises a processor 14 and a memory 15 (as shown schematically in the block diagram of FIG. 6). The controller 11 is configured to receive an input command signal from a descaling button 16 disposed on the housing 2. The memory 15 includes one or more pre-set programs for operation of the steam iron 10. The block diagram of FIG. 6 shows the coupling of the controller 11 to the heater 5, pump 8, inclination sensor 12, temperature sensor 13, descaling button 16 and an alarm 17.

One of the pre-set operation programs stored in the memory 15 of the controller 11 comprises a descaling process, wherein the controller 11 controls the heater 5 and water supply unit 6 to remove scale from the steam generating surface 4A and other internal components of the steam iron 10. The descaling process is activated upon actuation of the descaling button 16 by the user.

Figure 7:
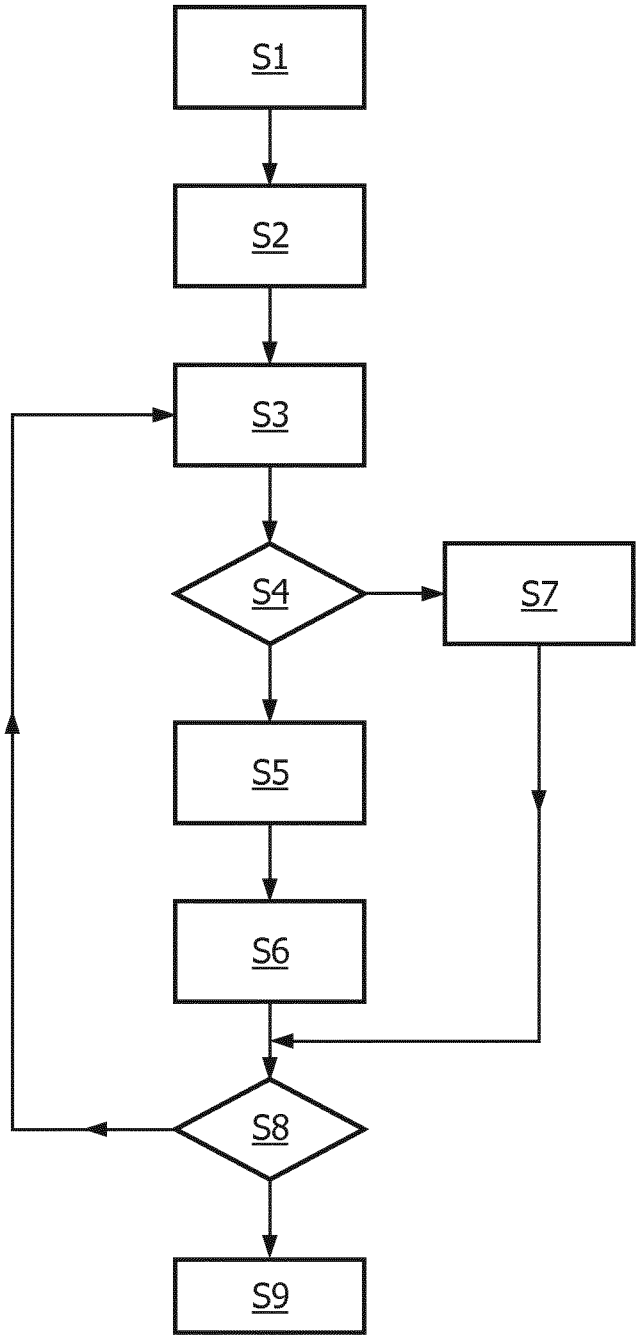

An exemplary operation of the descaling process of the steam iron 10 of the present invention is shown schematically in the flow chart of FIG. 7. At step S1, the user presses the descaling button 16 to select the descaling process. At step S2, the controller 11 ensures that the pump 8 of the water supply unit 6 is switched off to ensure that water is not supplied to the steam generating surface 4A by the water supply unit 6, and then moves to step S3. Step S2 ensures that any scale on the steam generating surface 4A is heated to a high temperature before water is supplied thereto such that the thermal shock effect is increased.

At step S3, the controller 11 retrieves a reading from the inclination sensor 12 to measure the inclination angle α of the steam generating surface 4A and then proceeds to step S4.

At step S4, the controller 11 compares the inclination angle α of the steam generating surface 4A measured by the inclination sensor 12 and retrieved in step S3 with a first predetermined value of inclination angle α. If at step S4 the controller 11 determines that the measured inclination angle α of the steam generating surface 4A is less than the first predetermined value of inclination angle α then the process proceeds to step S5. In the present embodiment, the first predetermined value of inclination angle α is 6 degrees. Therefore, if the steam generating surface 4A is inclined by less than 6 degrees from the horizontal X-X then the process proceeds to step S5.

At step S5, the controller 11 operates the heater 5 to heat the steam generating surface 4A to a predetermined temperature. In the present embodiment, the predetermined temperature is 180 degrees Celsius. However, in alternative embodiments, the predetermined temperature may be another value, for example between 150 and 250 degrees Celsius. The temperature sensor 13 is configured to measure the temperature of the steam generating surface 4A and is coupled to the controller 11 such that the controller 11 can determine when the steam generating surface 4A has reached the predetermined temperature. When the steam generating surface 4A reaches the predetermined temperature, the process proceeds to step S6.

At step S6, the pump 8 is operated by the controller 11 at high speed to supply liquid water from the water tank 7 to the steam generating surface 4A at the first flow rate. If at step S8 the pump 8 is already operated to supply liquid water to the steam generating surface 4A at the first flow rate, then the pump 8 is continued to be operated in such a manner. The liquid water supplied to the steam generating surface 4A during step S6 is cold relative to the predetermined temperature that the steam generating surface 4A is heated to during step S5. Therefore, any scale on the steam generating surface 4A will be subjected to thermal shock such that the scale is dislodged and broken into flakes and powder which can be flushed out of the steam chamber 4B by the liquid water and through the apertures (not shown) in the fabric treating face 3A.

If at step S4 the controller 11 determines that the measured inclination angle α of the steam generating surface 4A is equal to or greater than the first predetermined value of inclination angle α then the process proceeds to step S7. At step S7, the controller 11 ensures that the pump 8 is deactivated such that no liquid water is supplied to the steam generating surface 4A. Alternatively, the pump 8 is operated by the controller 11 at a substantially reduced speed such that a flow rate of liquid water is supplied to the steam generating surface 4A that is substantially less than the first flow rate.

In addition, as step S7 the controller 11 activates the alarm 17 that is coupled to the controller 11. The alarm 17 comprises a buzzer (not shown) and/or an indicator light (not shown), for example a bulb or LED. The alarm 17 is activated for a predetermined time period to alert the user that the steam generating surface 4A is inappropriately orientated for the descaling and then the process proceeds to step S8.

At step S8, the controller 11 determines whether the descaling button 16 is still depressed. If at step S8 the controller 11 determines that the descaling button 16 is no longer depressed, then the process proceeds to step S9 which is the end of the process and the heater 5 and water supply unit 6 are both switched off. If at step S8 the controller 11 determines that the descaling button 16 is still depressed, then the process loops back to step S3.

The controller 11 is configured such that when the descaling button 16 is depressed and the steam iron 10 is orientated such that the steam generating surface 4A is horizontal or is inclined such that the inclination angle α is less than the first predetermined value of inclination angle α then the pump 8 is operated continuously at a high speed to provide a continuous supply of liquid water to the heated steam generating surface 4A at the first flow rate. However, if the steam iron 10 is repositioned such that the inclination angle α of the steam generating surface 4A is equal to or greater than the first predetermined value of inclination angle α, then the controller 11 stops or substantially slows the pump 8 such that liquid water is no longer supplied to the steam generating surface 4A at the first flow rate. Similarly, if the steam iron 10 is positioned such that the inclination angle α of the steam generating surface 4A is equal to or greater than the first predetermined value of inclination angle α and then the descaling button 16 is subsequently pressed to select the descaling process, the pump 8 will not be operated to supply liquid water to the steam generating surface 4A at the first flow rate.

Since the controller 11 is configured such that during the descaling process the pump 8 is only operated to supply liquid water to the steam generating surface 4A at the high first flow rate when the inclination angle α of the steam generating surface 4A less than the first predetermined value of inclination angle α, the formation of a water deposit W in the steam chamber 4B is prevented. Therefore, the problem of the user being scalded by sudden bursts of steam and hot water during the descaling process is alleviated.

When the descaling process is not selected, the water supply unit 6 may be operated at a second flow rate, which is lower than the first flow rate, to supply liquid water to the steam generating surface 4A to generate steam for steaming a fabric. The pump 8 may be operated at different speeds to supply liquid water to the steam generating surface 4A at the first and second flow rates. In an alternative embodiment, the water supply unit 6 comprises a second pump (not shown) that is operated to supply water to the steam generating surface 4A at the second flow rate.

In the above described embodiment, when the descaling process is started and the process moves to step S5 such that the controller 11 controls the heater 5 to heat the steam generating surface 4A to the predetermined temperature, the controller 11 will continue to maintain the steam generating surface 4A at the predetermined temperature during the other steps of the descaling process until the descaling process is ended. For example, if the steam generating surface 4A is heated to the predetermined temperature and then the user moves the steam iron 10 such that the inclination angle α of the steam generating surface 4A is equal to or more than the first predetermined value of inclination angle α such that the descaling process proceeds to step S7, wherein the water supply unit 6 is prevented from supplying water to the steam generating surface 4A at the first flow rate, the steam generating surface 4A will be maintained at the predetermined temperature by the heater 5. Therefore, when the steam iron 10 is subsequently repositioned such that the inclination angle α of the steam generating surface 4A is less than the first predetermined value of inclination angle α, the user will not have to wait for the steam generating surface 4A to be reheated to the predetermined temperature before liquid water is supplied to the steam generating surface 4A at the first flow rate to remove scale therefrom. However, in an alternate embodiment (not shown), the heater 5 is switched off when descaling process moves from step S5 to step S6, and/or when the process moves to step S7.

In the above described embodiment, the first predetermined value of inclination angle α is 6 degrees. However, it should be recognised that the in other embodiments the first predetermined value of inclination angle α is a different value, for example in the range of 2 degrees to 90 degrees. In one such alternative embodiment, the first predetermined value of inclination angle α is 90 degrees such that the controller 11 prevents the water being supplied to the steam generating surface 4A at the first flow rate during the descaling process if the steam iron 10 is placed in an upright, non-ironing, position such that its heel 2A is rested on a flat surface 9A (as shown in FIG. 5). Therefore, the user is prevented from activating the descaling process and then leaving the steam iron 10 unattended in the upright position, which could otherwise result in a sudden burst of steam/hot water being ejected from the apertures in the soleplate 3 at the same moment a person moves in front of the soleplate 3.

In the present embodiment the steam generating surface 4A is a planar surface. However, in alternative embodiments the steam generating surface 4A has a different shape. In one such embodiment (not shown), the steam generating surface 4A has a U-shaped cross-section when viewed from the heel 2A.

In the above described embodiment, the descaling button 16 comprises a push-button that is depressed by the user for the duration of the descaling process. However, in an alternative embodiment (not shown) the controller 11 is configured such that the descaling button 16 only needs to be pressed to start the descaling process, at which point the descaling process will be performed for a predetermined time period after the descaling button 16 is pressed. In another embodiment (not shown), the descaling button 16 comprises a switch that is toggled to activate and deactivate the descaling process. In yet another embodiment (not shown), the steam iron 10 comprises a display that shows a user interface and the steam iron further comprises one or more buttons that are used to manipulate the user interface to select the descaling process. In one embodiment, the controller 11 is configured to control the display to show a warning message when the descaling process is selected and the measured inclination angle $\alpha$ of the steam generating surface 4A is equal to or greater than the first predetermined value of inclination angle $\alpha$.

In the above described embodiment the steam iron 10 comprises a temperature sensor 13 that is coupled to the controller 11 such that the controller 11 can determine when the steam generating surface 4A reaches the predetermined temperature. However, in an alternative embodiment (not shown) the temperature sensor 13 is omitted and instead the controller 11 is configured to operate the heater 5 at a predetermined power level for a predetermined time period to ensure that the steam generating surface 4A is at or above the predetermined temperature.

In the above described embodiment, the controller 11 is configured such that, when the descaling process is selected, the water supply unit 6 is prevented from supplying water to the steam generating surface 4A at the first flow rate if the steam generating surface 4A is inclined by equal to or more than the first predetermined value of inclination angle $\alpha$ in any direction. However, in an alternate embodiment, the water supply unit 6 is only prevented from supplying water to the steam generating surface 4A at the first flow rate if the steam generating surface is inclined by equal to or more than the first predetermined value of inclination angle $\alpha$ in a specific direction, for example only if the steam generating surface 4A is inclined upwardly in a direction away from the heel 2A by equal to or more than the first predetermined value of inclination angle $\alpha$. Said specific direction of the inclination of the steam generating surface 4A may be chosen to ensure that a water deposit W is prevented from accumulating in the steam chamber 4B between the nozzle 8A and the apertures (not shown) in the soleplate 3 to prevent the path of the steam through the steam iron 10 being blocked by the water deposit W.

Each of steps S1 to S9 of the descaling process may be performed for a predetermined period of time. The predetermined period of time may be the same for each step or, alternatively, some of steps S1 to S9 may be performed for different periods of time.

Although in the above described embodiment the supply of liquid water to the steam generating surface 4A is controlled by controlling the pump 8, in an alternative embodiment (not shown) the liquid water is supplied from the water tank 7 to the steam generating surface 4A by gravity and the flow rate of the liquid water supplied to the steam generating surface 4A is controlled by controlling a valve (not shown), for example a solenoid valve.

In the above described embodiments, the water tank 7 is disposed within the housing 2 of the steam iron 10. However, on an alternative embodiment (not shown), the water tank 7 is disposed in a separate stand or base unit and the liquid water is supplied from the base unit to the steam generating surface 4A via a hose. The pump 8 may be disposed in the housing 2 of the steam iron 10 or in the base unit.

In the above described embodiment the controller 11 is configured such that, when the descaling process is selected, the water supply unit 6 is prevented from supplying water to the steam generating surface 4A at the first flow rate if the inclination angle $\alpha$ of the steam generating surface 4A is equal to or greater than the first predetermined value of inclination angle $\alpha$. Therefore, a water deposit W is prevented from accumulating at a lower end of the steam chamber 4B. In an alternative embodiment, the controller 11 is configured to instead prevent the heater 5 from heating the steam generating surface 4A to the predetermined temperature if the descaling process is selected and the inclination angle $\alpha$ of the steam generating surface 4A is equal to or greater than the first predetermined value of inclination angle $\alpha$. In such an embodiment, the water supply unit 6 will supply liquid water to the steam generating surface 4A even if the inclination angle $\alpha$ of the steam generating surface 4A is equal to or greater than the first predetermined value of inclination angle $\alpha$ and so a water deposit W may form at the lower end of the steam chamber 4B. However, since in such a circumstance the heater 5 is not operated to heat the steam generating surface 4A to the predetermined temperature, the pressure of the steam in the steam chamber 4B is prevented from increasing to the point wherein the steam is forced through the water deposit W such that a burst of steam and hot water is suddenly vented through the apertures in the soleplate 3. In another embodiment, the water supply unit 6 is prevented from supplying water to the steam generating surface 4A at the first flow rate and the heater 5 is prevented from heating the steam generating surface 4A to the predetermined temperature when the descaling process is selected and the inclination angle $\alpha$ of the steam generating surface 4A is equal to or greater than the first predetermined value of inclination angle $\alpha$.

In the above described embodiment, the hand-held steaming device 10 is in the form of a steam iron 10. However, it should be recognised that the invention is suitable for use with other types of hand-held steaming device 10. For example, in one alternative embodiment the hand-held steaming device is in the form of a steamer head for a fabric steamer that is suitable for removing creases from a vertically hung fabric.

In the above described embodiment, the inclination sensor 12 is in the form of an inclinometer 12. The inclinometer 12 may comprise a digital or analogue inclinometer that is coupled to the controller 11. However, the inclination sensor 12 may comprise a different type of sensor that is capable of detecting the inclination of the steam generating surface 4A. In alternative embodiments, the inclination sensor 12 comprises an accelerometer, gyroscope and/or inertial measurement unit that is configured to detect the inclination angle $\alpha$ of the steam generating surface 4A with respect to the horizontal X-X. Alternatively, an orientation sensor in the form of a ball sensor may be used to determine if the steaming device is inclined by equal to or more than the first predetermined value of angle α. In another alternative embodiment, the inclination sensor 12 comprises a pressure sensor that is located on the heel 2A of the steam iron 10 such that the inclination sensor 12 can detect when the steam iron 10 is orientated in an upright position with the heel 2A located against a flat surface 9A such that the steam generating surface 4A is perpendicular to the horizontal X-X and therefore the inclination angle α is 90 degrees. In yet another embodiment (not shown), the steaming device 10 further comprises a descaling tray (not shown) that has a receiving surface which is parallel to the horizontal X-X. The fabric treating face 3A of the steam iron 10 is located on the receiving surface of the descaling tray during the descaling process to ensure that the steam, hot water and scale that is ejected from the apertures in the soleplate 3 are collected in the descaling tray. In one such embodiment, the inclination sensor comprises a sensor that detects when the fabric treating face 3A is disposed against the receiving surface of the descaling tray such that the steam generating surface 4A is parallel to the horizontal X-X. In such an embodiment, the inclination sensor 12 may comprise, for example, a pressure sensor located on one of the fabric treating face 3A or descaling tray. The controller 11 is configured such that water may only be supplied to the steam generating surface at the first flow rate if the descaling process is selected and the steam iron 10 is in position on the receiving surface of the descaling tray.

In one embodiment, the controller is configured to prevent the water supply unit 6 from supplying water to the steam generating surface 4A at the first flow rate and/or to prevent the heater 5 from heating the steam generating surface 4A to the first temperature when the descaling process is selected if the steam generating surface 4A is inclined by less than a second predetermined valued of inclination angle α. The second predetermined value of inclination angle α is smaller than the first predetermined value of inclination angle α. Therefore, liquid water will not be supplied to the steam generating surface 4A at the first flow rate and/or the steam generating surface 4A will not be heated to the first temperature if the steam generating surface 4A is inclined at an angle greater than the first predetermined value of inclination angle α, for example due to the steam iron 10 being rested on its heel 2A, or if the steam generating surface 4A is inclined at an angle that is less than the second predetermined valued of inclination angle α, for example due to the steam generating surface 4A being orientated horizontally when the steam iron 10 is operated to remove creases from a horizontally disposed fabric.

In one such embodiment, the receiving surface of the descaling tray is inclined at an angle between the first and second predetermined values of inclination angle α. Therefore, when the fabric treating face 3A, which is parallel to the steam generating surface 4A, is located against the receiving surface and the descaling process is selected, water is supplied to the steam generating surface 4A at the first flow rate and the steam generating surface 4A is heated to the first temperature such that scale can be removed therefrom. However, if the user moves the steam iron 10 such that the fabric treating face 3A is no longer located against the receiving surface and the steam generating surface 4A is inclined at an inclination angle α that is larger than the first predetermined value of inclination angle α or smaller than the second predetermined value of inclination angle α, then water will no longer be supplied to the steam generating surface 4A at the first flow rate and/or the steam generating surface 4A will no longer be heated to the first temperature. In one such embodiment, the first and second predetermined values of inclination angle α are 2 degrees and 6 degrees respectively and the descaling tray in inclined at an angle of 4 degrees, however is should be recognised that other values of these angles are intended to fall within the scope of the invention. In another embodiment, the controller 11 detects when the fabric treating face 3A is positioned on the descaling tray using, for example, a mechanical switch, magnetic sensor or a capacitive sensor. In one embodiment (not shown), the descaling tray forms part of a separate stand or base unit and the water tank 7 and/or pump 8 may be located in the separate stand or base unit, as discussed above.

It will be appreciated that the term "comprising" does not exclude other elements or steps and that the indefinite article "a" or "an" does not exclude a plurality. A single processor may fulfil the functions of several items recited in the claims. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A hand-held steaming device comprising:

a steam generating surface;

a heater to heat the steam generating surface;

a water supply unit to supply water to the steam generating surface;

a controller configured to perform a user selectable descaling process wherein the heater is operated to heat the steam generating surface to a first temperature and the water supply unit is operated to supply water to the steam generating surface at a first flow rate to remove scale from the steam generating surface; and, a sensor configured to detect the inclination of the steam generating surface with respect to the horizontal, wherein the controller is coupled to the sensor and is configured to prevent at least one of the following when the descaling process is selected if the steam generating surface is inclined by more than a first predetermined angle from the horizontal (X-X):

the water supply unit from supplying water to the steam generating surface at the first flow rate; and, the heater from heating the steam generating surface to the first temperature.

2. A hand-held steaming device according to claim 1, wherein the water supply unit is operable to supply water to the steam generating surface at a second flow rate to generate steam for steaming a fabric and the first flow rate is greater than the second flow rate.

3. A hand-held steaming device according to claim 1, wherein the first predetermined angle is in the range of 2 degrees to 90 degrees, and, preferably, is 6 degrees.

4. A hand-held steaming device according to claim 1, wherein the controller is configured to prevent at least one of the following when the descaling process is selected if the steam generating surface is inclined by less than a second predetermined angle from the horizontal (X-X), wherein the second predetermined angle is smaller than the first predetermined angle:

the water supply unit from supplying water to the steam generating surface at the first flow rate; and, the heater from heating the steam generating surface to the first temperature.

5. A hand-held steaming device according to claim 1, wherein the controller is configured to prevent the water supply unit from supplying water to the steam generating surface when the descaling process is selected unless the temperature of the steam generating surface is at least the first temperature.

6. A hand-held steaming device according to claim 1, comprising a temperature sensor that is coupled to the controller and is configured to detect the temperature of the steam generating surface.

7. A hand-held steaming device according to claim 1, comprising a heel and wherein the controller is configured to prevent the water supply unit from supplying water to the steam generating surface at the first flow rate if the hand-held steaming device is rested on the heel.

8. A hand-held steaming device according to claim 1, wherein the water supply unit comprises a pump and, preferably, wherein the pump comprises at least one of a motor and a solenoid and the controller is configured to control the at least one of the motor and the solenoid to control the flow rate of water supplied to the steam generating surface by the water supply unit.

9. A hand-held steaming device according to claim 1, comprising an alarm and wherein the controller is configured to activate the alarm if the descaling process is selected and the steam generating surface is inclined by more than the first predetermined angle from the horizontal.

10. A hand-held steaming device according to claim 9, wherein the alarm comprises at least one of an audible alarm and a visual alarm and, preferably, wherein the alarm comprises at least one of a buzzer and a flashing LED.

11. A hand-held steaming device according to claim 1, comprising a steam chamber, wherein the steam generating surface forms a wall of the steam chamber, and wherein the controller is configured to prevent a water deposit accumulating in the steam chamber that blocks a flow of steam out of the steam chamber.

12. A hand-held steaming device according to claim 1, comprising a steam generating plate having a major surface that comprises the steam generating surface.

13. A hand-held steaming device according to claim 1, wherein the hand-held steaming device is in the form of a steam iron.

14. A descaling process for removing scale from the steam generating surface of a hand-held steaming device, wherein the hand-held steaming device comprises a heater to heat the steam generating surface and a water supply unit to supply water to the steam generating surface, wherein the descaling process comprises the steps of:

controlling the heater to heat the steam generating surface to a first temperature;

controlling the water supply unit to supply water to the steam generating surface at a first flow rate;

detecting the inclination of the steam generating surface with respect to the horizontal (X-X); and, preventing at least one of the following if the steam generating surface is inclined by more than a first predetermined angle from the horizontal (X-X):

the water supply unit from supplying water to the steam generating surface at the first flow rate; and, the heater from heating the steam generating surface to the first temperature.

15. A controller comprising a memory and a processor configured to perform the descaling process steps according to claim 14.

* * * * *